US008444287B2

(12) United States Patent
Hardesty

(10) Patent No.: US 8,444,287 B2
(45) Date of Patent: May 21, 2013

(54) LIGHTED FLOORING

(76) Inventor: Gary Lawrence Hardesty, Oakland, MD (US)

( * ) Notice: Subject to any disclaimer, the term of this patent is extended or adjusted under 35 U.S.C. 154(b) by 219 days.

(21) Appl. No.: 12/986,936

(22) Filed: Jan. 7, 2011

(65) Prior Publication Data

US 2011/0310595 A1 Dec. 22, 2011

Related U.S. Application Data

(60) Provisional application No. 61/355,235, filed on Jun. 16, 2010.

(51) Int. Cl.

| | |
|---|---|
| ***F21S 8/02*** | (2006.01) |
| ***F21S 4/00*** | (2006.01) |
| ***F21V 3/00*** | (2006.01) |
| ***A47L 23/24*** | (2006.01) |
| ***E04F 15/02*** | (2006.01) |

(52) U.S. Cl.

CPC *F21S 8/022* (2013.01); *F21S 4/003* (2013.01); *F21V 3/00* (2013.01); *A47L 23/24* (2013.01); *E04F 15/02166* (2013.01)

USPC ..... 362/153; 362/249.02; 362/311.02; 362/311.14; 15/216; 52/181

(58) Field of Classification Search

USPC ..... 362/145, 153, 153.1, 249.02, 249.04, 362/311.02, 311.14; 15/215, 216, 217; 52/177, 52/180, 181

See application file for complete search history.

(56) References Cited

U.S. PATENT DOCUMENTS

| | | | | |
|---|---|---|---|---|
| 4,329,739 | A | 5/1982 | Loebner | |
| 4,340,929 | A * | 7/1982 | Konikoff et al. | 362/153 |
| 4,737,764 | A | 4/1988 | Harrison | |
| 4,855,882 | A * | 8/1989 | Boss | 362/238 |
| 5,095,412 | A | 3/1992 | French | |
| 5,499,170 | A * | 3/1996 | Gagne | 362/153 |
| 5,848,830 | A | 12/1998 | Castle et al. | |
| 6,074,074 | A * | 6/2000 | Marcus | 362/240 |
| 6,371,637 | B1 | 4/2002 | Atchinson et al. | |
| 6,481,877 | B1 | 11/2002 | Bello, Jr. | |
| 6,523,986 | B1 * | 2/2003 | Hoffmann | 362/153 |
| 6,540,378 | B2 * | 4/2003 | Alsup | 362/253 |
| 6,646,545 | B2 | 11/2003 | Bligh | |
| 6,718,576 | B1 | 4/2004 | Shih | |
| 7,119,704 | B2 * | 10/2006 | Grzan et al. | 340/665 |
| 7,144,139 | B2 * | 12/2006 | Kramer et al. | 362/249.04 |
| 7,255,454 | B2 | 8/2007 | Peterson | |
| 7,549,784 | B1 * | 6/2009 | Teeters | 362/576 |
| 7,597,949 | B2 * | 10/2009 | Wright | 428/116 |

(Continued)

OTHER PUBLICATIONS

Swisstrax, http://www.swisstrax.com/ribtrax-garage-tile.php; Jan. 7, 2011.

*Primary Examiner* — Alan Cariaso

(74) *Attorney, Agent, or Firm* — The Law Firm of Andrea Hence Evans, LLC

(57) ABSTRACT

A portable flooring having integral illumination devices. The flooring comprises a panel having channels extending along a front portion of the panel. Light strips in the channels are supported by the back portion of the panel. The light strips have a covering that extends along the length of the light strips. A top surface of the covering and a top surface of the panel are on the same plane. The flooring can support large weighted objects.

15 Claims, 6 Drawing Sheets

U.S. PATENT DOCUMENTS

| | | | | |
|---|---|---|---|---|
| 7,670,022 | B2 * | 3/2010 | Kessler et al. | 362/153 |
| D623,343 | S * | 9/2010 | Kluš | D26/138 |
| 8,206,002 | B1 * | 6/2012 | Olson | 362/153.1 |
| 2006/0126330 | A1 | 6/2006 | Yen | |
| 2009/0126139 | A1 | 5/2009 | Batti et al. | |
| 2009/0167213 | A1 | 7/2009 | Hoffman | |

* cited by examiner

LIGHTED FLOORING

RELATED APPLICATIONS

The present application is a continuation of prior U.S. Patent Application 61/355235 filed on Jun. 16, 2010, the entirety of which is incorporated herein by reference.

FIELD OF THE INVENTION

The present invention relates in general to flooring and in particular to a mat having illumination devices that provide lighting in a dim or dark area.

BACKGROUND OF THE INVENTION

Flooring is available in various shapes, size, and colors. Smaller dimensioned flooring such as mats are placed over surfaces for providing protection to a larger flooring underneath the mat. Mats may also be used to provide comfort and cushion to one having to stand or lay on the mats for long time periods. Floor mats also provide safe surfaces on which to walk, preventing slips and falls that cause injury and liability damages. A well-used mat can trap and hold dirt and allergens, preventing their spread.

SUMMARY OF THE INVENTION

This invention introduces portable flooring in the form of a mat having integral illumination devices.

An aspect of an embodiment of the invention provides the mat being positioned on a surface whereby the illumination devices project onto a surface above the mat.

A further aspect of an embodiment of the invention provides the mat and illumination devices being durable to support and withstand large weight objects.

A further aspect of an embodiment of the invention provides the mat having channels that house the illumination devices.

Additional aspects, objectives, features and advantages of the present invention will become apparent from the following description of the preferred embodiments with reference to the attached drawings.

DETAILED DESCRIPTION OF THE INVENTION

Figure 1:
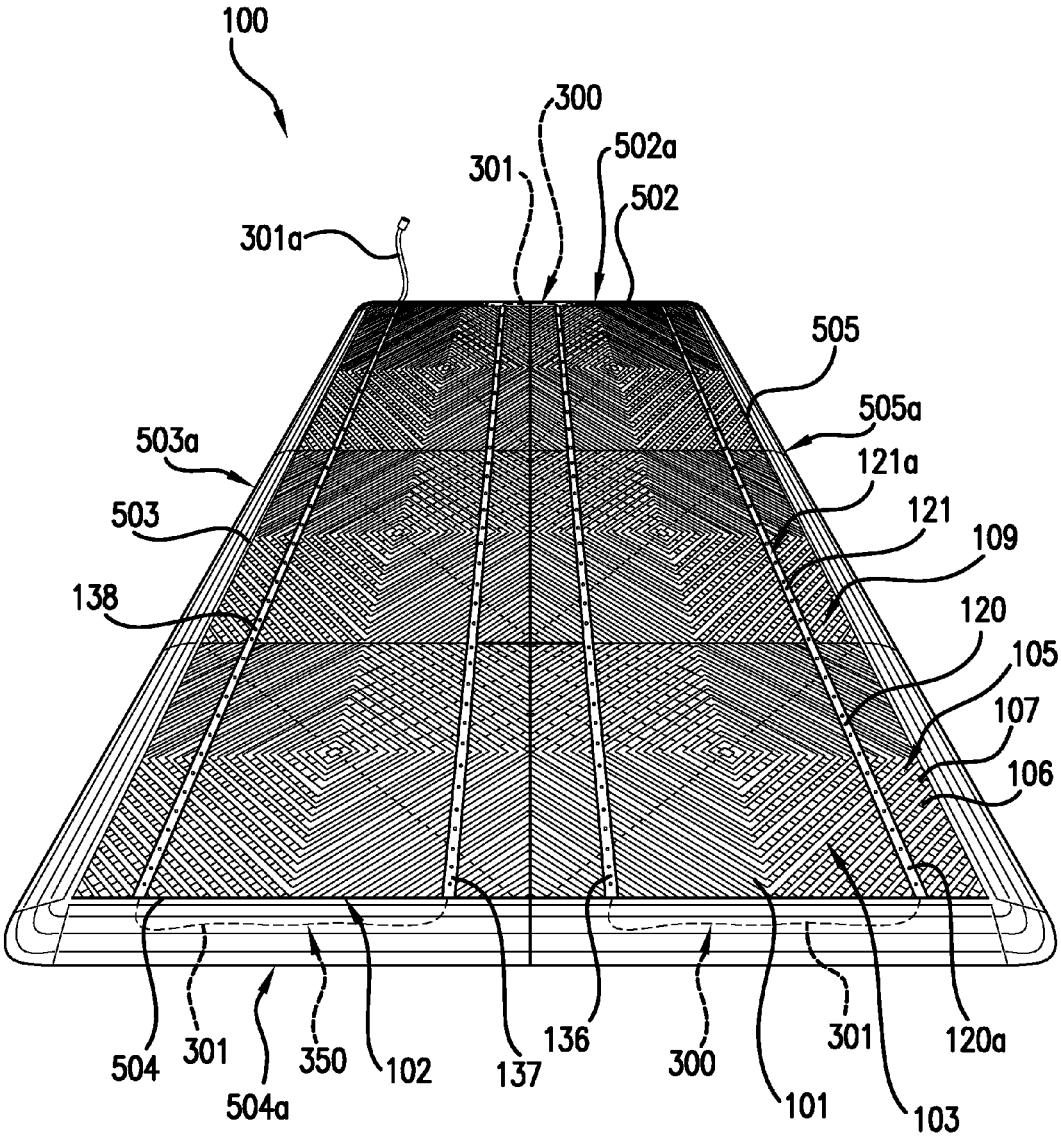
FIG. 1 is a perspective view of the lighted flooring.

FIG. 1 is a perspective view of the lighted flooring 100. The flooring 100 features tiles 101 connected together to form a panel 102. The panel can have a length of 4 ft and a width of 3 ft to create a mat. The tiles 101 are in a square shape having connection mechanisms that allow the tiles 101 to lock into each other. Additional shapes of tiles may be used to form a panel with a different shape. The panel size or dimensions are based on the number of tiles connected and the panel can be made larger or smaller.

Figure 3:
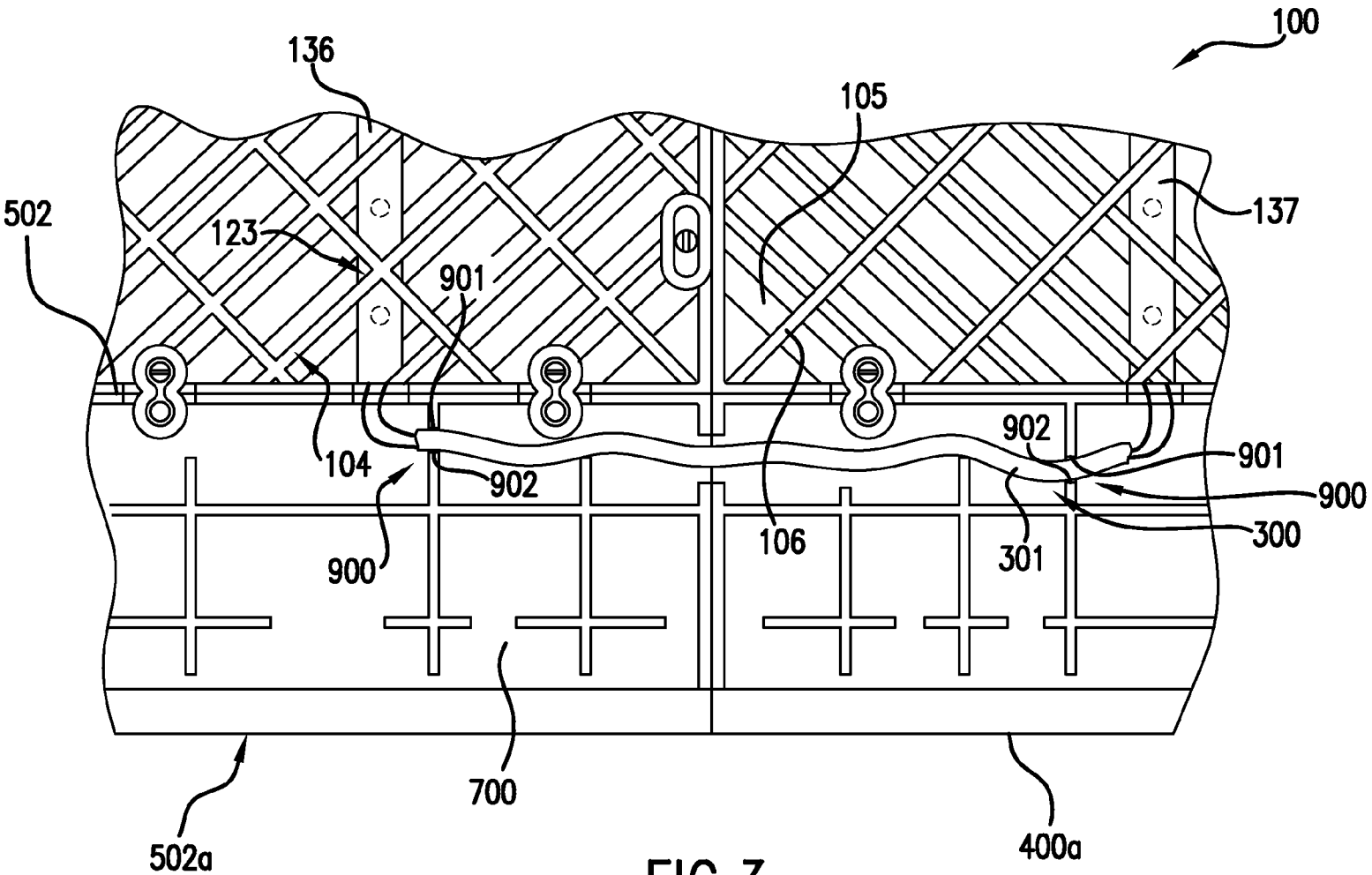
FIG. 3 is a back view of the lighted flooring illustrating a light strip connection and an outer edge.

The tiles have a front portion 103 and a back portion 104, shown in FIG. 3. In a preferred embodiment of the invention, the tiles 101 are made of front ribs 105 on the front portion 103 of the tiles 101 and back ribs 106 on the back portion 104 of the tiles 101. The front ribs 105 rest on the back ribs 106 in a checkerboard fashion such that the front and back ribs are positioned to form apertures between them 107. The ribs 105, 106 can form an alternate pattern or design. However, spaces 107 are formed between each front rib 105 which allow unwanted fluid such as oil or gas or small objects to pass through the spaces 107.

Figure 6:
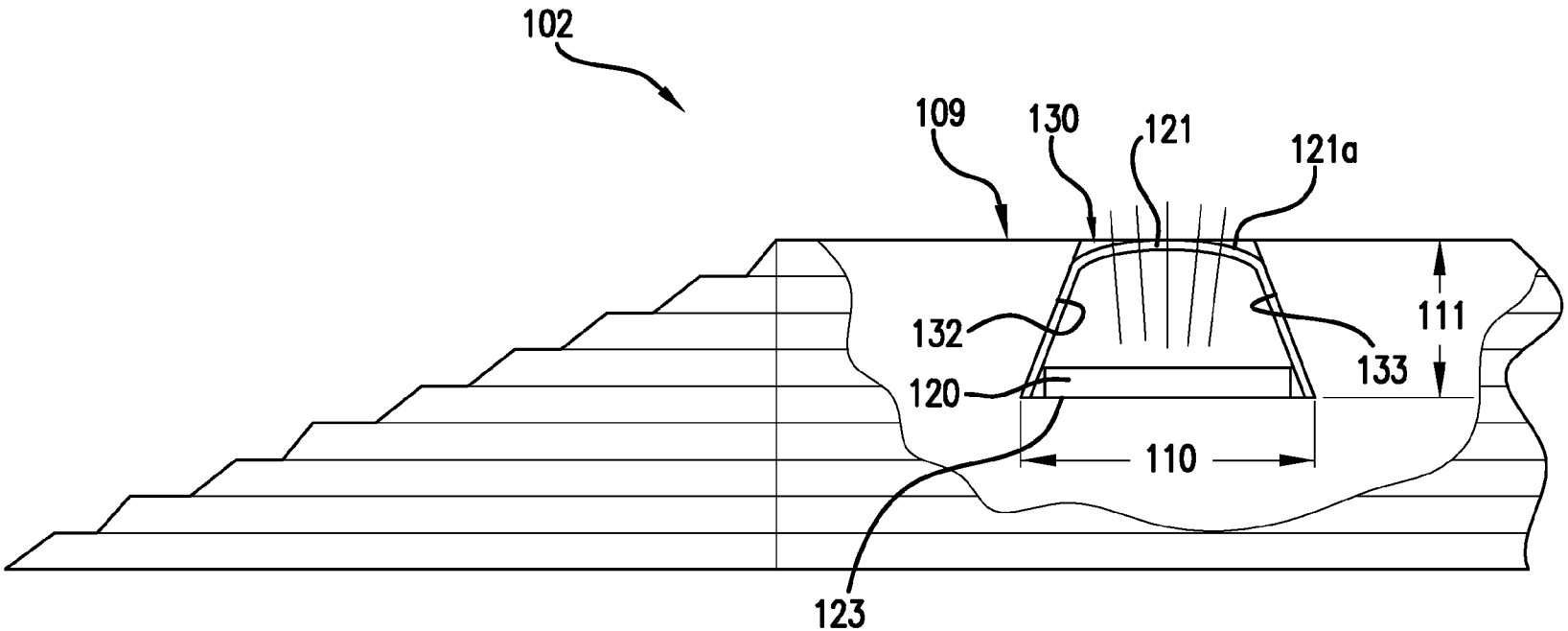
FIG. 6 is an end view of the lighted flooring.

Alternatively, the tiles may be designed such that they do not contain spaces 107. The tiles are made from a polypropylene copolymer having a light weight and they are able to support large weight objects. The material may be a polymer able to support objects. Each tile is about 15.75 square inches but may be made to be smaller or larger based on the space for the flooring 100. Additional tiles may be connected to form a panel to cover the floor of a large room or the panel may be designed to fit underneath smaller objects such as motorcycles or bikes. When the tiles 101 are connected to form the panel 102, the panel 102 can support the weight of large objects such as cars or trucks. Each tile comprises a tile channel 108. The tile channels 108 have a width 110 and a depth 111 as shown in FIG. 6.

The channels 108 are recessed into the panel 102. FIG. 6 is an end view of the lighted flooring. The depth 111 is the area from the top surface 109 of the panel 102 to the bottom of the light strip 120. The width 110 is about ½ in wide and the depth 111 is about ¼ in below the top surface 109 of the panel 102. The width of the channel may be larger or smaller based on the size of the light strips 120. Also, the depth may be larger based on the thickness of the light strips 120. A top surface 123 of the back ribs 104 contacts the bottom of the light strip 120 and provides additional support for the light strip 120. The tile channels 108 can be aligned on each panel as shown in FIG. 1 or the channels may be cut to form symbols, numbers or designs. As shown in FIG. 1, the channels are symmetrical on a first and second half of the panel. In FIG. 1, the tiles channels 108 are aligned and form a first channel 130. The channels are formed by cutting the front ribs at a location on the tiles.

In an alternative embodiment, a panel can be sized to a desired size for a mat or flooring. The panel will be in the form of a sheet of material. A top surface 109 of the panel 102 can be cut to form channels 108 on the panel 102 as shown in FIG. 6. The channels 108 will be cut a width 110 to support a light strip 120 and will be cut a depth 111 from a top surface of the panel to a top surface of the bottom of the panel, such that the top surface of the bottom of the panel supports the bottom of the light strip where it comes into contact with the outer covering of the strip. The channels 108 are cut and sized to hold the light strips in position. The covering of the light strip is flush with the top surface of the panel.

Illumination devices, a LED light strip 120 having a waterproof sheath covering 121 is positioned in the first channel 130. The LED light strip is long lasting, saves energy, is durable and ultra-bright. The light strip 120 is a flexible strip in the form of a ribbon or rope. The channels 108 are cut such that side cuts 132, 133 are angled and the top surface of the back rib is flat. It is preferred the cuts 132, 133 be angled for added protection, however, a square cut can be made in the event the flooring will not be used in a high traveled area. The angled cuts 132, 133 are a dove-tail shaped. The angled cut sides 132, 133 are angled to act as a bridge to protect the light strips. The LED strips 120 are recessed in the channels in a manner that prevents them from being crushed or damaged when the panel is supporting a large object. The cuts 132, 133 allow the strips 120 to be positioned such that no additional covering is necessary, once the strips are positioned in the channels 108.

For example, the panel 102 can be positioned in a location on the floor of an auto mechanics shop. When a vehicle is driven over the mat the covering 121 and the side cuts 132, 133 prevent the LEDs from being damaged. When a car is lifted, the mechanic can keep his hands free and use the light emitted by the LEDs 120*a* to see underneath the car. The LED strips 120 act as a spotlight. When the LED strips 120 are in the channel 130, the top 121*a* of the covering 121 is flush with the top surface 109 of the front ribs 105. The top surface of the covering and the top surface of the tiles are on the same plane. No additional covering is required above the covering 121 of the light strips 120. The channels are sized to receive the light strips 120 and there are no gaps such that the light strip plugs the channels 130.

Figure 2:
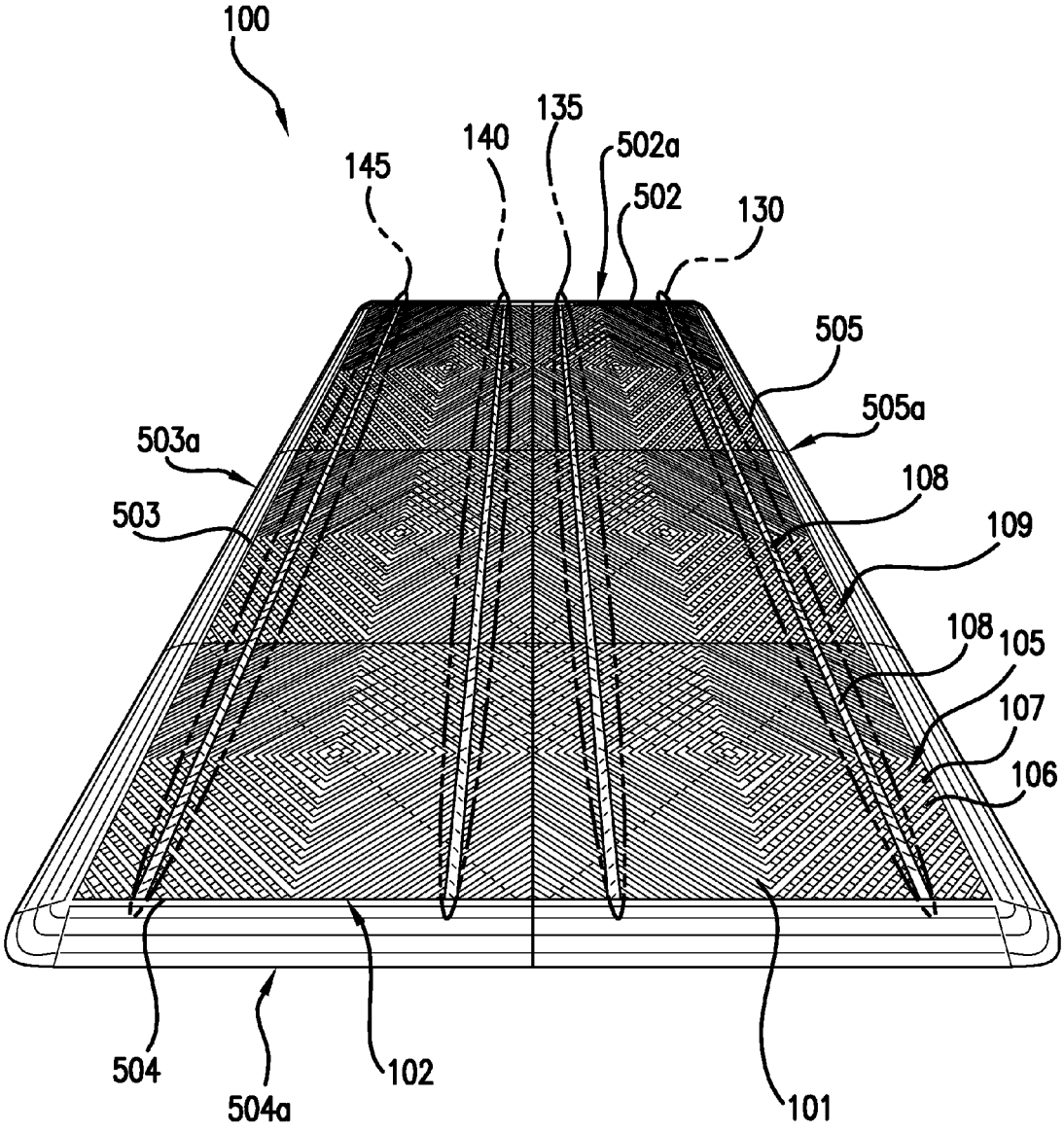
FIG. 2 is a perspective view of the lighted flooring without the light strips.

A first channel 130 and an LED strip 120 have been described. The features and functions of the first channel are the same as the second channel 135, third channel 140 and fourth channel 145 as shown in FIG. 2. FIG. 2 is a perspective view of the lighted flooring without the light strips. A second light strip 136, third light strip 137 and fourth light strip 138 are supported by the second 135, third 140 and fourth channels 145, respectively. The light strips features are the same as the first light strip 120. Depending on the design desired, the flexibility of the light strips 120 afford bending the lights in a desired shape or design of the supporting channel.

Figure 5:
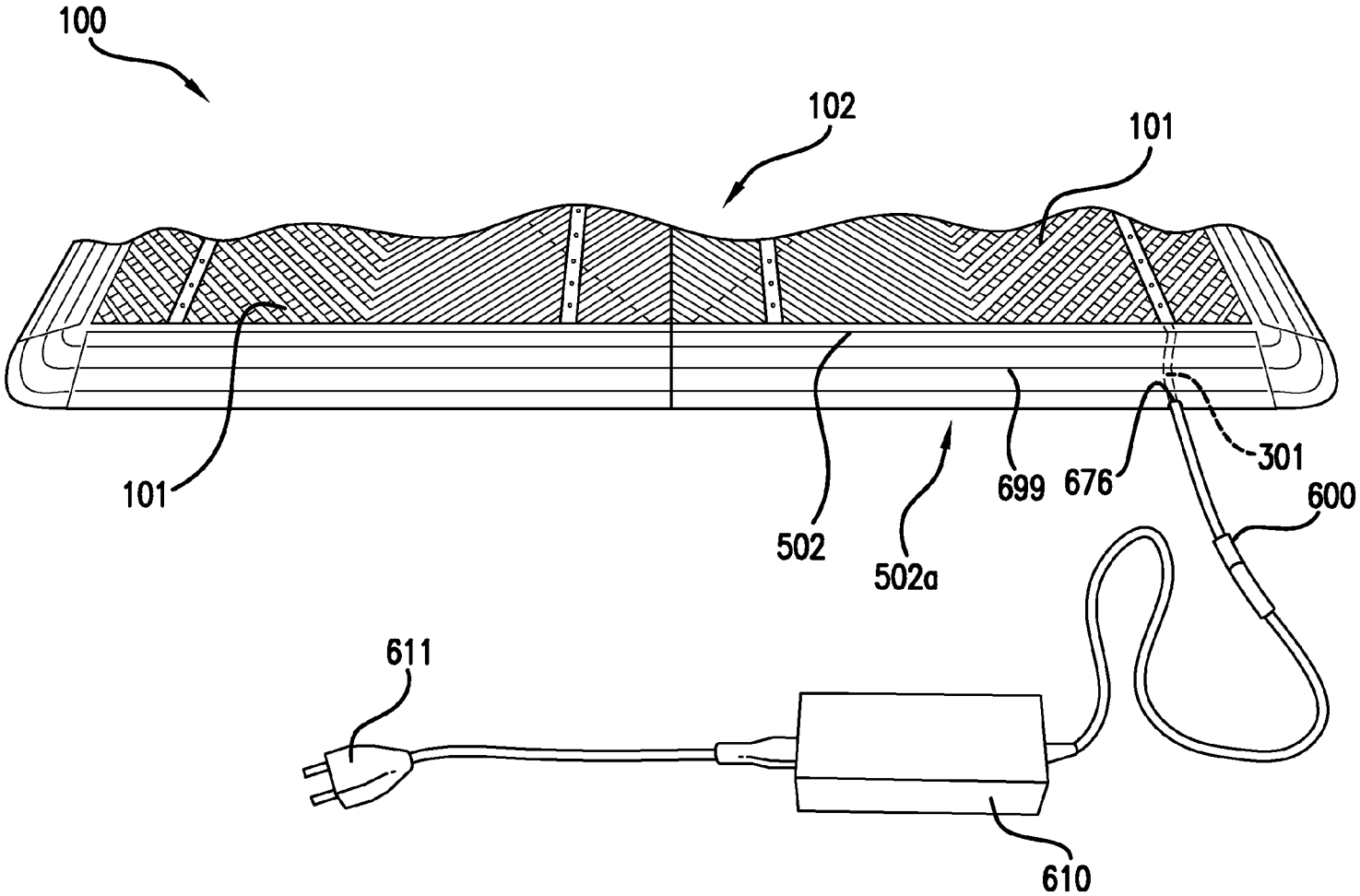
FIG. 5 is a front view of the lighted flooring illustrating a cord extending out of the panel and an outer edge.

FIG. 3 is a back view of the lighted flooring 100 illustrating a light strip connection 300 and an outer edge 400*a*. The light strips 120, 136, 137 and 138 have light strip wiring 301 connected to each other along a single path so that the same current flows through all of the strips. The light strips 120, 136, 137 and 138 extend through the channels 130, 135, 140, 145 to the panel edges 502, 504. Wiring 301 extends beyond the panel edges 502 and 504 and are connected to each other. The wiring would extend beyond panel edges 503 and 505 if the channels were cut to extend between edges 503 and 505. Wires 301 from the first strip 120 are connected to the wires 301 of the second strip 136. Wires 301 from the second strip 136 are connected to the wires 301 of the third strip 137. Wires 301 from the third strip 137 are connected to the wires of the fourth strip 138. The remaining wire 301*a* is connected to an adapter 600 that attaches to a converter 610 having a plug 611 on its end which can be plugged into a standard 110 wall outlet as shown in FIG. 5. FIG. 5 is a front view of the lighted flooring illustrating a cord extending out of the panel and an outer edge 502*a*. The converter 610 reduces the power of the LED strips 120, 136, 137, and 138. To contain and conceal the wiring 301, outer edges 502*a*, 503*a*, 504*a* and 505*a*, receive the wiring 301 on the edges bottom side 700 shown in FIG. 3.

The outer edges 502*a*, 503*a*, 504*a* and 505*a* are made from the same durable material as the tiles so that they can also support large weight objects. The edges 502*a*-505*a* form a slight angle on its front outer edge side 699 and act as a ramp. The ramp makes an easier transition for rolling tools on the mat or driving onto the ramp. The outer edges are fitted onto the panel edges. Brackets 900 are evenly spaced on the bottom side 700 of the edges 502*a*-505*a*. The brackets 900 are cuts underneath the edges 502*a*-505*a* that have a first and second bracket side wall 901, 902. The area between the side walls 901 and 902 are such that the wiring 301 fits snuggly between the walls 901 and 902 and are held firmly in position. Electrical tape may be used around the wires to prevent them from disconnecting.

Figure 4:
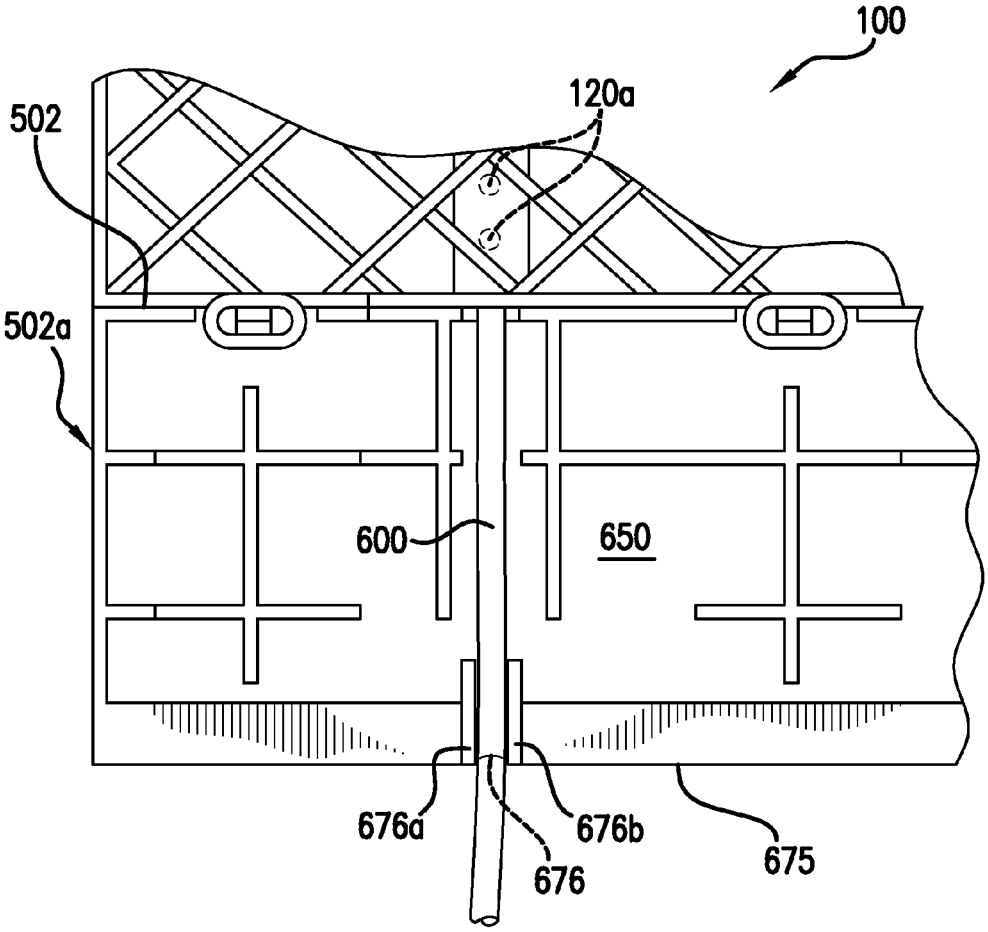
FIG. 4 is a back view of the lighted flooring illustrating a cord extending out of the panel and an outer edge.

FIG. 4 is a back view of the lighted flooring illustrating a cord extending out of the panel 102 and an outer edge 502*a*. Wire 301 is connected to an adaptor 600 that makes direct contact with the back outer edge 650 of the outer edge 502*a*. The outermost perimeter 675 has an opening 676 that is cut a height such that the bottom of the adaptor cord is level with the bottom of the outermost perimeter 675. The walls 676*a*, 676*b* of the perimeter 675 prevent the cord from moving out of its desired position.

Clips can be used on a bottom side of the panel to further hold the LED strips in place and the clips may be used on the outer edges to hold the wiring in position.

A power cord is shown, however, other known power source methods such as batteries or solar power may be used to power the light strips. A switch may be added. Also, dimmers may be added to the flooring to allow the brightness of the light strips to be altered. Additionally, timers may be added to the flooring to provide when the strips will be powered on and off.

The flooring acts as a spotlight underneath vehicles and provides an efficient and inexpensive method of lighting dim or dark areas such as front porches or other areas. The materials are lightweight so that the flooring can be transported.

The invention has been described in detail with particular reference to certain preferred embodiments thereof, but it will be understood that variations and modifications can be effected within the spirit and scope of the invention.

The invention claimed is:

1. A flooring comprising: tiles connected together to form a panel, wherein the tiles have a front portion and a back portion; at least one front rib disposed on the front portion of the tiles; at least one back rib disposed on the back portion of the tiles; a first channel formed across the at least one front rib on the front portion of the panel, wherein the first channel features angled side cuts that are narrow at a top of the first channel and wider at a bottom of the first channel; a first light strip positioned in the first channel and a top surface of the at least one back rib contacts a bottom of the first light strip, wherein the first light strip is flush with a surface of the at least one front rib.

2. The flooring of claim 1 further comprising outer edges having a front outer edge side and a back outer edge side, wherein the back outer edge side comprises brackets that receive a first light strip wiring.

3. The flooring of claim 2, wherein the first light strip wiring is connected to a power converter having a corded plug.

4. The flooring of claim 2, wherein the outer edges are angled and act as a ramp.

5. The flooring of claim 1, wherein the first light strip further comprises a waterproof sheath surrounding the strip.

6. The flooring of claim 1, wherein the front and back ribs are positioned to form apertures between them.

7. The flooring of claim 1 further comprising a second channel on the front portion of the panel, wherein a second light strip is positioned in the second channel; whereby the first and second light strip may be connected.

8. A flooring comprising: a panel, wherein the panel has a front portion and a back portion; front ribs are disposed on the front portion of the panel; back ribs are disposed on the back portion of the panel; recessed channels formed across the front ribs and extending along the front portion of the panel; wherein the recessed channels feature angled side cuts that are narrow at a top of the recessed channels and wider at a bottom of the recessed channels; light strips are disposed in the channels supported by the back portion of the panel and a top surface of the back ribs contacts a bottom of the light strips, wherein the light strips have a covering that extends along the length of the light strips; wherein a top surface of the covering and the front portion of the panel are on the same plane.

9. The flooring of claim 8, wherein the panel comprises panel edges, wherein the panel edges are connected to outer edges that receive a light strip wiring.

10. The flooring of claim 8, wherein the light strips comprise wiring that connects the light strips along the outer edges.

11. A portable flooring comprising: a panel having a front surface and a back surface; front ribs are disposed on the front surface of the panel; back ribs are disposed on the back surface of the panel; a first, second, third and fourth channel formed across the front ribs and extending along the front surface of the panel; wherein the channels feature angled side cuts that are narrow at a top of the channels and wider at a bottom of the channels; a first light strip, second light strip, third light strip and fourth light strip supported by the first, second, third and fourth channels, respectively, and a top surface of the back ribs contacts bottoms of the first, second, third and fourth light strips; wherein the first, second, third and fourth light strips are connected along an edge of the panel; a covering surrounding the light strips; wherein a top surface of the covering and a front surface of the panel are flush.

12. The portable flooring of claim 11, wherein the channels are symmetrical on a first and second half of the panel.

13. The portable flooring of claim 11, wherein the light strips are flexible.

14. The portable flooring of claim 11, wherein the light strips are recessed in their respective channels.

15. The portable flooring of claim 11, wherein the flooring can support large weighted objects.

* * * * *